United States Patent [19]

Vosper et al.

[11] 4,356,970

[45] Nov. 2, 1982

[54] ENERGY SAVING FUEL OIL ATOMIZER

[75] Inventors: Ralph R. Vosper, San Jose; Norman E. Harthun, San Carlos, both of Calif.

[73] Assignee: Coen Company, Inc., Burlingame, Calif.

[21] Appl. No.: 131,988

[22] Filed: Mar. 20, 1980

Related U.S. Application Data

[63] Continuation-in-part of Ser. No. 40,390, May 18, 1979, Pat. No. 4,303,386.

[51] Int. Cl.[3] ..... B05B 7/10; F23D 11/12

[52] U.S. Cl. ..... 239/8; 239/290; 239/403; 239/419.3; 239/422; 239/424.5; 239/427.3

[58] Field of Search ..... 239/8, 11, 290, 400, 239/403, 405, 406, 419, 419.3, 422, 424, 424.5, 425, 427.3-428, 431, 433, 434, 434.5

[56] References Cited

U.S. PATENT DOCUMENTS

| | | | |
|---|---|---|---|
| 783,898 | 2/1905 | Scherding | 239/427.5 |
| 1,020,348 | 3/1912 | Gardner | 239/427.5 |
| 1,161,183 | 11/1915 | Beach | 239/405 |
| 2,933,259 | 4/1960 | Raskin | 239/431 X |
| 3,310,240 | 3/1967 | Grundman | 239/428 X |
| 4,141,505 | 2/1979 | Reich | 239/431 |

*Primary Examiner*—Andres Kashnikow
*Attorney, Agent, or Firm*—Townsend and Townsend

[57] ABSTRACT

A high efficiency liquid fuel atomizing nozzle for use in conjunction with industrial furnaces is described which employs a pressurized gas such as steam for supplying the atomizing energy. The nozzle typically has a plurality of discharge ports and defines, on its interior, a pressurized fuel compartment and a pressurized steam chamber. A core stream of steam is flowed from the steam chamber along an axis obliquely inclined relative to the longitudinal axis of the nozzle to each port. Liquid fuel from the fuel compartment is flowed towards each core stream and divided substantially equally into a number of fuel branch flows which equals the number of core streams. Each branch flow is then brought generally tangentially into contact with the associated core stream so as to form a substantially homogenous, annular fuel stream which surrounds the core stream. As the fuel comes into contact with the core stream, it is atomized so that the annular fuel flow is a flow of small droplets which surrounds the core flow. A secondary, annular stream of steam is formed for each core stream at a point downstream of the point at which the fuel stream is combined with the core stream and envelopes the combined stream. The three streams are then discharged from the associated port into the furnace for combustion of the fuel therein.

38 Claims, 4 Drawing Figures

ENERGY SAVING FUEL OIL ATOMIZER

RELATED APPLICATIONS

This application is a continuation-in-part application of the copending patent application bearing Ser. No. 040,390, filed May. 18, 1979 and entitled IMPROVED FURNACE BURNER, now U.S. Pat. No. 4,303,386.

BACKGROUND OF THE INVENTION

Industrial liquid fuel atomizers, or nozzles, often employ steam to effect the atomization of the fuel as it is injected into furnaces, boilers and the like. Typically, such nozzles employ energy from the steam to transform the liquid fuel into minute, suspended droplets, or to atomize the fuel, so as to assure an efficient combustion and minimize the discharge of pollutants.

The fuel atomizing steam must, of course, be separately generated and requires an amount of energy that is directly proportional to the amount of steam that is consumed by the nozzle. In the past, efficient nozzles consumed steam at a rate of about 0.1 to 0.4 lbs. of steam per pound of fuel oil atomized by the nozzle and discharged into the furnace. The generation of this steam heretofore added as much as 2.8% to the fuel consumed by the furnace. Fuel expended for generating atomizing steam is essentially lost as an energy source for the furnace and, in the overall energy balance of the furnace constitutes wasted energy. Consequently, in view of rapidly escalating energy costs, it is highly important to minimize the consumption of fuel atomizing steam and thereby reduce energy waste.

Although a certain amount of energy (supplied by the steam) is necessary to apply the required shear forces to the liquid fuel so as to transform it into small droplets, a large if not a major portion of the energy carried by the atomizing steam is simply dissipated in the nozzle due to the intricate shape of passages through which the steam must travel, which is an inefficient use of the steam, so that much of it is discharged from the nozzle without really contributing to the atomization of fuel, etc.

An additional problem encountered with many atomizing nozzles, which during operation are subjected to high temperature from the surrounding combustion chamber of the furnace, is a fouling of the nozzles, or at least portions thereof due to the deposition of fuel particles on (hot) nozzle surfaces contacted by the fuel, a coking of such particles and the like. This requires a frequent cleaning of the nozzle, with a corresponding downtime for the burner and further contributes to the discharge of pollutants due to the formation of incompletely combusted fuel particles, the formation of soot and the like which is discharged as part of the exhaust to the atmosphere and/or which can foul surfaces of the furnace or the exhaust stack. Accordingly, there is presently a need for a liquid fuel atomizing nozzle which overcomes the heretofore encountered shortcomings in general and which specifically reduces the energy consumption of such nozzles.

SUMMARY OF THE INVENTION

The present invention provides a nozzle capable of atomizing liquid fuel (hereinafter frequently "oil") into a homogenous spray of fine droplets with a steam requirement of as little as one-third of the steam required by prior art oil atomizing nozzles. This is accomplished primarily by constructing the nozzle so that a substantial portion of the atomizing steam travels through the nozzle substantially unidirectionally, that is without having to pass through a multitude of small passages having sharp, e.g. 90° turns which dissipate great amounts of the energy contained in the steam. A nozzle constructed in accordance with the present invention can result in fuel savings for the overall operation of the furnace of as much as 2% or more. At today's energy prices, this can translate into annual cost savings per nozzle of as much as $100,000.00.

Further, the nozzle of the present invention is constructed so that oil issuing from discharge ports of the nozzle is enveloped by a layer of steam as it passes through conduits in the nozzle. Any direct contact between the fuel and the nozzle, especially in the vicinity of the hottest portions of the nozzles is thereby prevented. This eliminates the heretofore troublesome coking of oil on the nozzle and the resulting deposit of coke, soot and the like on the surrounding burner, the furnace walls and the exhaust stack. Typically, a nozzle constructed in accordance with the present invention experiences no coking and can be virtually continuously operated while prior art nozzles had to be removed from the burner and cleaned every two to eight hours.

Generally speaking, this is accomplished in accordance with the present invention by providing a nozzle which typically has a plurality of atomized fuel oil discharge ports and which defines first and second, separated chambers interiorly of the nozzle. A core stream of steam is flowed from the first chamber along an axis inclined relative to the longitudinal axis of the nozzle to each port. Fuel oil from the second chamber is flowed towards each core stream and divided substantially equally into a number of fuel branch flows which equals the number of core streams. Each branch flow is then brought generally tangentially into contact with the associated core stream so as to form a substantially homogenous, annular fuel stream which surrounds the core stream. As the fuel comes into contact with the core stream, typically when it exits from appropriately oriented and located apertures, the fuel is atomized so that the annular fuel flow is a flow of small droplets which surrounds the core flow but which may also be at least partially mixed with the latter.

Further, a secondary, annular stream of steam is formed for each core stream at a point downstream of the point at which the fuel stream is combined with the core stream. The combined core and fuel stream (hereinafter sometimes "combined stream") is enveloped within the secondary stream and the pressure of the combined stream and of the secondary stream are preferably equalized at about the point where the latter envelopes the former so as to minimize turbulence. The three streams (hereinafter sometimes the "full stream") are then discharged from the associated nozzle port into the furnace for combustion of the fuel therein.

The secondary stream of steam separates the atomized fuel from walls of the common conduit until the fuel is discharged from the associated port. Thus, direct contact between the fuel and the hottest portions of the nozzle is prevented and a corresponding fouling of nozzle surfaces and the frequent cleaning of the nozzle necessitated thereby are eliminated. The nozzle of the present invention, therefore, requires substantially less maintenance and can be operated over much longer time periods between servicing.

To assure an equal discharge of fuel from each port of the nozzle, and to prevent gravity from causing differences in the fuel discharge rate due to elevational differences of the ports, the fuel oil is flowed from the second chamber through a supply pipe against a perpendicular wall which forms part of a passageway that leads to the discharge conduit. The supply pipe is dimensioned so that the fuel flows against the perpendicular wall at a rate of about 40 ft. per second when the nozzles operates at its maximum design capacity. This relatively high flow rate effectively negates any adverse, gravity induced effects on the fuel oil flow rate to the discharge conduits of the nozzle. Once the fuel flows in the passage that leads to the discharge conduits a substantially equal division of the fuel flow has been accomplished and the flow rate can be reduced by as much as 50% or to about 20 ft. per second at full operating capacity. The relatively high fuel velocities have the further advantage that a clogging of the supply pipe and the passages is much less likely to occur because most obstructions will normally be carried away by the high speed flow of the oil. Yet, this flow rate is sufficiently low so that undue pressure drops are not encountered.

To prevent turbulence in the core flow the enveloping secondary steam stream is oriented parallel to the discharge conduit before it is brought into contact with the combined stream. In this manner, the secondary stream of steam forms an envelope which essentially does not disturb the laminar flow of the atomized fuel.

Best results are obtained when the full stream is discharged into the combustion chamber of the furnace at relatively high speed but with virtually no pressure differential between it and the pressure prevailing in the combustion chamber. Accordingly, it is preferred to adjust the pressure of the full stream just upstream of the discharge port to about the pressure in the combustion chamber. This is done by appropriately diverging the conduit walls in a downstream direction from a point downstream of the point where the secondary steam stream is introduced to the discharge port.

As far as the actual construction of the nozzle is concerned, in a presently preferred embodiment of the invention, it has a generally axially oriented housing which defines first and second, separated chambers. At least one and normally two or more discharge conduits in fluid communication with the first chamber extend through the housing to the exterior thereof. Their outer ends define the discharge ports of the nozzle.

The conduit itself has first, second, and third axially aligned and spaced apart sections of generally successfully larger cross-sectional dimensions which serially extend from the first chamber through the housing to the discharge port at the end of the third section. A first passage is defined by the housing and communicates the first chamber with an upstream end of the third conduit section. A second passage fluidly communicates the second chamber with an upstream end of the second section. Means is further associated with each of the first and second passages which flows the respective fluid media peripherally and substantially uniformly into the corresponding conduit sections.

Thus, upon the introduction of a pressurized gas, e.g. steam into the first chamber and the introduction of a pressurized liquid fuel, e.g. oil into the second chamber a gas-fuel mixture is formed in the third conduit section which comprises a primary or core stream of steam, a generally surrounding, annular, atomized fuel oil stream, and a secondary stream of steam which envelopes the fuel stream. The streams of steam cause the atomization of the liquid fuel and protect housing walls defining the conduit and in the vicinity of the port from direct contact with the fuel to thereby prevent the fouling of such surfaces by fuel particles.

In a presently preferred embodiment, the first, or steam chamber is an annular chamber which concentrically surrounds a fuel compartment defining the second chamber. The latter is separated from the former by a cylindrical wall defined by an insert attached to or integrally constructed with the housing. This arrangement minimizes the intricacies of the paths along which steam must flow to form the primary and secondary steam streams and thus minimizes the consumption of energy. Further, in a presently preferred embodiment, the first and second conduit sections, including specifically the point at which the fuel oil is introduced are defined by a separate insert which sealingly engages the housing and facilitates the formation of tangentially oriented fuel injecting apertures. The tangential orientation of fuel injected into the conduit assures a thorough a homogenous atomization of the fuel at a point well upstream of the discharge port which enhances the efficiency with which the fuel is combusted in the furnace.

Alternatively, the central chamber can be utilized as the steam chamber with oil introduced into the surrounding, annular shaped chamber. This embodiment can be combined with a discharge conduit that is simply drilled through the housing. The cost of the nozzle can thereby be reduced.

DESCRIPTION OF THE PREFERRED EMBODIMENTS

Figure 1:
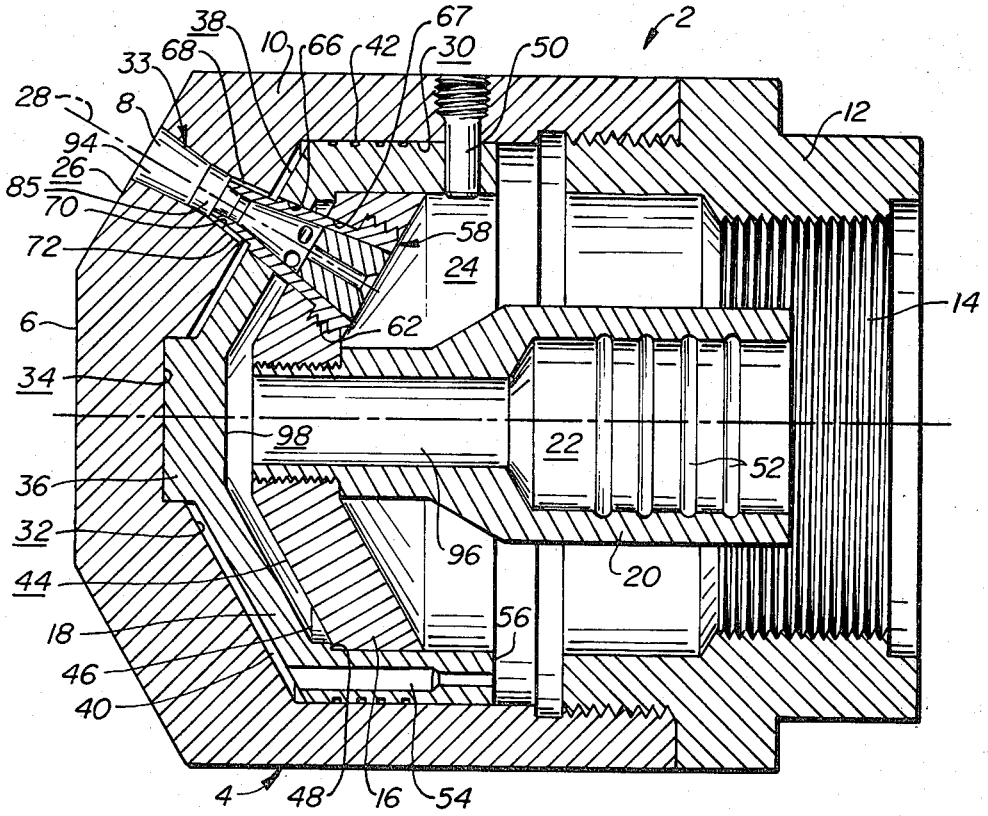
FIG. 1 is a side elevational view, in section, of a liquid fuel atomizing nozzle constructed in accordance with the present invention.
Figure 2:
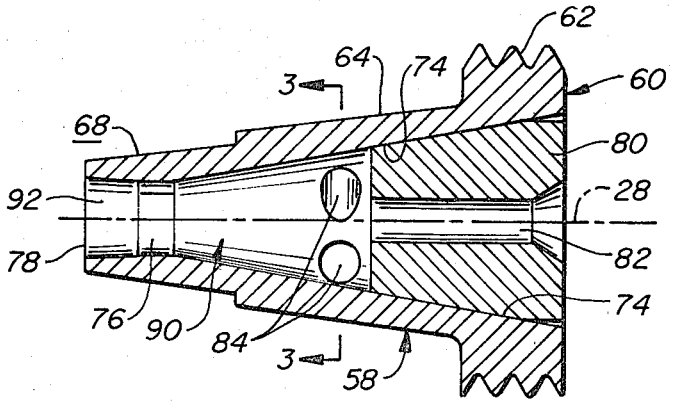
FIG. 2 is an enlarged, side elevational view, in section, of a portion of the combined steam-fuel discharge conduit constructed as an insert that is positioned in the housing of the fuel nozzle.
Figure 3:
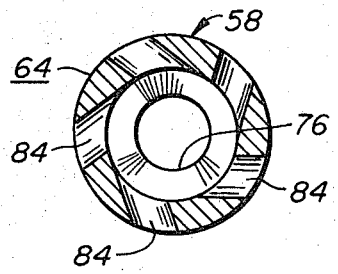
FIG. 3 is an end view, in section, of the insert that is taken on line 3—3 of FIG. 2.

Referring to FIGS. 1-3, a fuel oil atomizing nozzle 2 constructed in accordance with the present invention broadly comprises a generally cylindrical housing 4 which has a forward end 6 that faces the combustion chamber (not shown) of a furnace and which defines a plurality, say 6, discharge ports 8 (only one of which is shown in FIG. 1) from where atomized fuel oil is discharged into the furnace. The housing is formed by an end cap 10 and a connector 12 which has a rearwardly facing, threaded bore 14 sized to be threadably secured to a pipe (not shown) connected to a source of steam (not shown). The housing further includes first and second, interiorly disposed and axially spaced apart inserts 16, 18 and an oil supply tube 20 threaded onto the former and protruding rearwardly generally coaxially with bore 14 for fluid connection to a source of fuel oil (not shown). The inserts and the supply tube are arranged so that the housing defines a centrally located fuel compartment 22 at the aft end of the tube and a surrounding, generally annularly shaped steam chamber 24 separated from the compartment by the tube. The housing further includes passages and conduits as further described below, for fluidly connecting the compartment and the chamber with port 8 for discharging atomized liquid fuel therefrom when the compartment and the chamber hold pressurized fuel oil and pressurized steam, respectively.

The forward end 6 of the end cap 10 is defined by a planar end face and a conically shaped ring surface 26 which is perpendicular to an axis 28 of port 8. Interiorly, the end cap has a bore which is shaped complementarily to the exterior surfaces of the cap and thus defines a cylindrical surface 30, a conical interior surface 32 and a planar end face 34. The aft end of the cap threadably engages connector 12.

The outer insert 18 is shaped complementary to the interior surfaces 30, 32 and 34 of end cap 10 except that it includes a cylindrical forward projection 36 which engages end face 34 of the cap and which is of sufficient length so as to space a conical surface 38 of the insert some distance from the opposing conical cap surface 32 so as to define between them a generally conically shaped secondary steam passage 40. Suitable labyrinth seals 42 arranged over the cylindrical length of the outer insert seal the secondary steam passage from the remainder of the housing interior. To establish fluid communication between the secondary steam passage 40 and steam chamber 24 the cylindrical portion of the outer insert 18 includes one or more, generally axially oriented bores 54 which extend from a rearwardly facing end 56 the passage and thereby enable the flow of steam from the chamber to the passage.

The inner insert 16 is shaped complementary to outer insert 18 and includes a conical surface 44 which faces a rearwardly oriented, opposing surface on the outer insert and which is spaced therefrom so as to define a generally frustoconical fuel oil passage 46. A peripheral portion of the inner insert rests on a recess 48 in the outer insert which limits the axial approach of the inner insert and thereby maintains the fuel passage. Preferably, the inner insert is welded, brazed or soldered to the outer insert so as to immovably secure the two to each other while a threaded dowel pin 50 extends radially through the end cap and the outer insert and accurately positions the two with respect to each other.

The center of the inner insert 16 is threaded and receives the forward end of oil supply tube 20, thereby establishing fluid communication between fuel passage 46 and fuel compartment 22. The aft end of the tube is adapted for connection to a pipe to fluidly communicate the oil compartment 22 with a supply of pressurized fuel oil (not separately shown). The aft end of supply tube 20 may be provided with glands 52 which receive suitable labyrinth seals to establish a seal with such a pipe.

Steam and fuel flow to discharge ports 8 through conduits 33 which are coaxial with their respective port axes 28. Each conduit extends outwardly from the steam chamber 24 to the associated port and is inclined to the main axis of the housing by a relatively small angle of no more than about 45° and preferably by an angle in the range of between about 15° to 30°. The inner portion of the conduit, that is the portion relatively proximate to the steam chamber is defined by an elongate bushing 58 which has a relatively wide, innermost base 60 and which converges forwardly, or in a downstream direction. The base includes an exterior thread 62 which engages a corresponding interior thread in the inner insert 16. An outer, forwardly tapered sealing surface 64 firmly engages correspondingly tapered holes 66, 67 in the outer and inner insert 18, 16, respectively, and establishes a gas-tight seal therewith. The forward end of the bushing includes a stepped down, i.e. reduced diameter tapered steam guide surface 68 which is parallel to but spaced apart from a parallel conical bore 70 in the end cap 10 so as to define an annular steam path 72, the upstream end (to the right, as seen in FIG. 1) of which communicates with secondary steam passage 40 over the entire circumference of the steam path.

On the interior, the bushing includes a conical bore 74 which converges from base 60 towards a generally cylindrical constriction 76 just upstream of the forward or downstream end 78 (left hand end as viewed in FIG. 2) of the bushing. A plug 80 is inserted into the upstream end of the bore and extends from the base of the bushing to a point roughly aligned with conical surface 44 of the inner insert 16 as is best illustrated in FIG. 1. The plug includes a reduced diameter, generally cylindrical, concentric opening 82 which extends over the full length of the plug.

An advantage obtained from using tangentially oriented oil supply aperture 84 rather than radially oriented apertures stems from the fact that it is desirable to shear the oil droplets from a wall surface with the atomizing steam rather than trying to shear small droplets off a large droplet in "mid air". With radially oriented apertures relatively large droplets, of often too large a size remain in the stream and are discharged from the discharge port 8.

Further, the bushing includes a plurality, normally at least two and preferably five or more generally tangentially oriented fuel supply apertures 84 which are arranged in a common plane and which are sized so that the entire apertures fall within the width of fuel supply passage 46. The center line of the aperture is approximately tangent to the periphery of the cylindrical opening 82 in plug 80.

The remainder of conduit 33 is defined by a cylindrical conduit length 85 concentric with axis 28 and contiguous with the conical bore 70 and a forwardly flared conduit end 94 which terminates in discharge port 8.

In operation, pressurized fuel oil and steam are applied to compartment 22 and chamber 24, respectively. The steam forms a primary or core stream of steam which flows generally coaxially with conduit 33 in a downstream direction from the chamber through plug opening 82 past the bushing 58 and the discharge port.

Pressurized fuel oil flows from the fuel compartment 22 through a forward section 96 of fuel supply pipe 20 into the frustoconical fuel oil passage 46 and hence through the tangential apertures 84 into the interior of bushing 58 just downstream of the end of plug 80. Thus, generally tangentially oriented jets of fuel oil pass through the apertures and are sheared into minute droplets, or atomized, by the central core stream issuing from plug 80. The latter continues in a downstream direction and after passing the apertures it becomes enveloped by and at least partially mixed with a resulting, generally annular fuel stream of substantially uniformly distributed fuel oil droplets, thereby forming the combined fuel oil-steam core stream The enlarged cross-section or conduit 33 immediately downstream of the end of plug 80 facilitates the atomization of the fuel droplets. The tangential orientation of the fuel inlet apertures 84 contributes significantly to the uniform atomization of the fuel oil.

The combined stream continues in a downstream direction past a converging middle section 90 of conduit 33 extending generally from the downstream end of plug 80 past cylindrical constriction 76 to the forward end 78 of the bushing. The converging conduit section eliminates or at least substantially reduces turbulence in the combined stream, and particularly turbulence which may be present in the annular fuel stream in the area of the tangential apertures so that a substantially laminar, combined stream flows through the construction 76. In addition, the combined steam is accelerated as it travel both towards constriction 76 along the converging section 90 and along the diverging portion 92 of the insert downstream of the constriction.

Pressurized steam also flows from steam chamber 24 through steam bore 54 into the secondary steam passage 40. From there it passes into the conical steam path 72 on the outside of bushing 58 and since the passage completely surrounds the periphery of the conical path an annular secondary steam flow is formed which envelopes the combined stream issuing from the downstream end of the bushing. Contact between oil droplets in the combined stream and end cap 10 is thereby prevented. The downstreammost end 92 of the bore through bushing 58 is constructed so that it equalizes the pressure of the combined stream with the pressure of the enveloping secondary steam stream. In the illustrated embodiment, this portion of the conduit diverges outwardly.

From bushing 58 conduit 33 is first generally cylindrical and then merges into the forwardly flared conduit end 94 which ends in discharge port 80. The divergence of the conduit end 94 is selected so that at the discharge port, the full stream, generally comprising the steam core stream, the surrounding, annular fuel stream and the enveloping secondary steam stream, has a pressure equal to the pressure prevailing in the combustion chamber of the furnace (not separately shown).

Thus, the full stream is formed over generally three distinct sections of conduit 33. The first, upstream section of the conduit extends over the length of plug 80 in bushing 58 and establishes the primary or core steam stream. The second section of the conduit begins at about the point where fuel oil is introduced through the tangential apertures 84. In it the fuel is atomized and formed into a generally annular fuel stream surrounding and at least partially mixed with the core stream, thereby forming the combined stream. The combined stream is thereafter enveloped within the annular, secondary steam stream at the upstream end of a third or outermost section of the conduit beginning at about the downstream end of bushing 58. To prevent the introduction of turbulence, and to thereby prevent possible piercing of the enveloping steam stream by atomized fuel oil, the pressure of the combined stream is equalized with the pressure of the enveloping stream upstream of the bushing end. In the third conduit section, therefore, which experiences the highest temperatures since it is closest to the combustion chamber of the furnace, direct contact between the fuel droplets and the conduit walls is prevented by the enveloping secondary steam stream. Consequently, a fouling of the conduit wall, the formation of soot and the like is substantially prevented.

Further, the pressure of the full stream travelling through the third conduit section is equalized with the pressure prevailing in the combustion chamber to prevent an "exploding" of the stream into the combustion chamber. Instead, the full stream is accelerated to accomplish pressure equalization and since the stream does not experience a pressure drop as it issues from the discharge port, it can be directed into the combustion chamber as necessary in order to optimize the combustion of the fuel and the heat transfer to heat exchange surfaces (not shown) in the combustion chamber.

Although FIG. 1 illustrates only one conduit 33, typically nozzle 2 will be provided with a plurality, say 6, 5 or more equally spaced apart conduits. Since nozzles are typically horizontally oriented, there is a slight hydrostatic pressure differential between some of the conduits due to differences in their respective elevations. Although the pressure differential is small, it may be sufficient to cause a noticeable, unequal fuel flow through the conduits which can adversely affect the combustion of the fuel and, thereby, the efficiency of the nozzle, unless separately compensated for. The slight hydrostatic pressure differentials makes it difficult to compensate for them by appropriately differing the sizes of the tangential fuel supply apertures 84 in the respective bushings 58, for example. Further, this would require a precise orientation of the nozzle in the burner which is normally difficult if not impossible to attain.

To nevertheless assure an equal fuel distribution to all nozzle conduits, the forward portion 96 of fuel supply pipe 20 is dimensioned so that fuel oil flows at about 40 ft. per second at maximum capacity operation of the nozzle. Although this flow rate is constant over the entire length of the forward portion of the fuel pipe, it is important that it is present at the downstream end of the pipe just before it merges into the fuel passage 46 so that the oil impinges on the opposing surface 98 of inner insert 16 at a relatively high velocity. This results in an equal oil distribution to all discharge conduits 33 by substantially negating the gravitational force on the oil as above described. Equal oil distribution is achieved even when the nozzle is operated at reduced capacity. Yet, the indicated oil velocity is such that it does not result in excessive pressure drops in the oil supply pipe during full capacity operation.

Once the oil reaches the frustoconical fuel passage 46 the fuel oil velocity therein can be reduced to about one-half or about 20 ft. per second since the flow in the passages does not have an appreciable effect on the oil distribution to the conduits of the nozzle provided the initial distribution at the end of oil supply pipe 20 is equal.

The tangential oil supply apertures 84 are sized to provide an oil velocity through them which is sufficiently high to attain good oil distribution in conduit 33 as well as to prevent a plugging of the apertures. An oil velocity of 50 ft. per second at maximum flow rates has been found to yield satisfactory results both during full and during reduced capacity operation of the nozzle.

The size of the primary steam opening 82 in plug 80 is dictated by both the overall quantity of steam used for atomizing the fuel oil and by the ratio between the primary and the secondary steam streams as well as by the steam pressure prevailing in the steam chamber 24, the secondary steam passage 40 and conical steam path 72 just upstream of the point where secondary steam enters conduit 33. Preferably the flow ratio between the primary and secondary streams is about 1:1 and the overall quantity of steam used is between about 0.03 kg to about 0.05 kg of steam per kg of oil. Further, best oil atomization and stream homogeneity are attained when the diameter ratio between steam opening 82 in the plug and constriction 76 in the bushing 58 is about 0.6.

In another embodiment of the invention, the relative positions of the fuel compartment and the steam chamber are reversed so that the latter is centrally disposed while the former annularly surrounds it. This embodiment is somewhat simpler and, for example, lends itself for use in instances in which the provision of a separate steam-oil combining and atomizing bushing is not desired. Instead, the conduit through which the steam and oil streams flow and in which they are combined is formed directly into the housing and its component parts, essentially by drilling therethrough.

Figure 4:
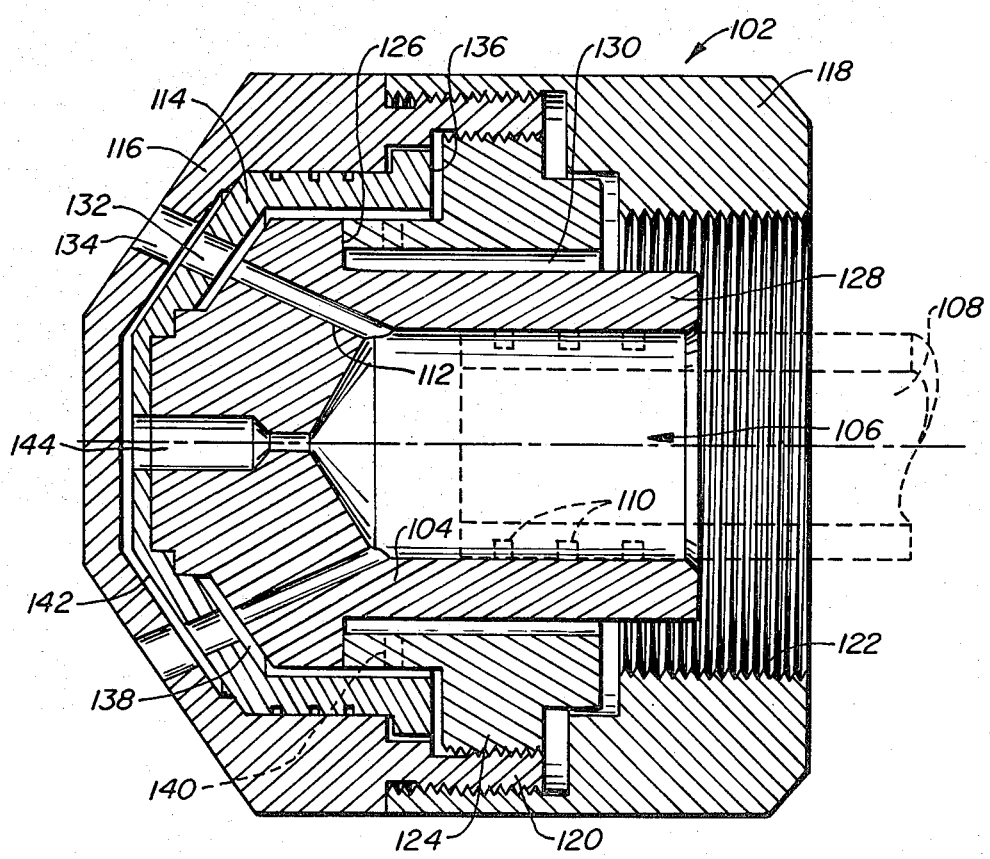
FIG. 4 is a side elevational view, in section, of a nozzle constructed in accordance with another embodiment of the invention.

Referring now to FIG. 4, a nozzle 102 constructed in accordance with a second embodiment of the invention has an inner member 104 which defines a steam chamber 106 that is coaxial with the nozzle axis. The chamber opens rearwardly (to the right as seen in FIG. 4) and has a smooth cylindrical surface so that a steam supply pipe 108 (shown in phantom lines) can be slidably inserted into the inner member. The supply pipe includes grooves 110 for establishing a seal labyrinth between the pipe and the steam chamber.

A cup-shaped insert 114 which has a cylindrical portion extending rearwardly over and surrounding the inner member 104 is placed over the latter and a nozzle cap 116 which, in turn, surrounds the insert is placed over the insert. The nozzle further includes an end fitting 118, the forward end of which threadably and sealingly engages a rearwardly protruding, cylindrical portion 120 of the cap while its aft end includes a threaded aperture 122 for connection to a fuel supply pipe (not shown) which concentrically surrounds steam supply pipe 108. Lastly, the nozzle includes a ring 124 which threadably and sealingly engages the inside of cylindrical cap portion 120 and which abuts against a shoulder 126 of the inner member 104. The ring is circumferentially spaced from an aft end 128 of the inner member to define therebetween a liquid fuel, e.g. oil receiving compartment 130.

Upon the tightening of ring 124 against shoulder 126 of the inner member, the latter together with the insert 114 are firmly biased against the nozzle cap 116 to form a self-contained nozzle unit. Fitting 118 can be threaded onto and removed from this nozzle unit to provide access to the interior of the unit should that become necessary.

The inner member 104 includes a plurality of equally spaced, circumferentially arranged steam discharge conduits 112 which extend at a slight angle to the nozzle axis of as little as 15°–30° (and preferably in the range of between 24°–26°) in a forward direction. The insert 114 includes a like plurality of first holes 132 which are aligned with steam conduits 112 and which have a diameter larger than that of the conduits. The cap 116 includes a like plurality of second holes 134, which form the fuel discharge jets of the nozzle, and which are similarly aligned with steam conduits 112. Their diameter is larger than the diameter of the first holes. Thus, the first and second holes are aligned with, are successively further spaced from, and have successively larger diameters than steam conduits 112.

The rearwardly facing side of insert 114 between its aft end 136 and the first hole 132 is recessed so as to form a first channel or passageway which extends from the aft end to the first hole. The first passage is formed so that it entirely surrounds the second hole. A plurality of tangentially oriented oil supply holes 140 extend through ring 124 from oil compartment 130 to the first passage so that pressurized oil introduced into the compartment can flow into the first passage and hence towards first hole 132. When steam is applied to steam chamber 106, it flows through steam conduit 112 and hence through the first and second holes 132, 134 to form a core steam flow. Pressurized oil applied to compartment 130 flows through the first passage 138 and around the entire circumference of the first hole 132 coaxially about the steam core stream to form an annular oil flow which surrounds the steam core and which flows through the first hole towards the second hole. To assure an even distribution of the oil flow to all first holes the tangent holes are slanted so as to impart to the oil entering the first passage 138 a swirling motion. This results in a more even oil distribution to all first holes. Preferably, the number of oil supply holes 140 exceeds the number of first holes by a factor of up to 2.

During operation the nozzle cap 116 is subjected to intense heat radiation. If oil to be atomized contacts the cap, e.g. the walls of the second hole 134, it has a tendency to coke along the walls. Although the normally high oil velocity will prevent a clogging of the hole the coke or carbon is later on deposited on the furnace walls, the stack and the like as soot and may further accumulate at a point of discharge of the oil from the cap, making it necessary to frequently clean the nozzle.

To prevent this from happening, the cap is constructed so that a portion of its inwardly facing surface opposite the outwardly facing surface of insert 114 is spaced therefrom to define a second passage 142 which communicates with all second holes 134 and which entirely surrounds the second holes in the same manner in which the first passage surrounds the periphery of the first holes. Further, an aperture 144 communicates the steam chamber 106 with the second passage 142. Thus, upon the application of pressurized steam to chamber 106, the steam flows via the aperture and the second passage to the second hole 134. There it flows as an annular steam envelope which entirely surrounds the annular oil flow into the second hole and prevents contact between the walls of the second hole, that is between the cap 116 and the oil stream, thereby preventing the above-discussed coking and sooting.

In operation, steam is continuously fed to chamber 106 while oil is fed to the compartment 130. From there the steam primarily forms a core flow through steam conduits 112 which, as it travels outwardly through the first and second holes 132, 134 is first enveloped by the annular oil flow which, in turn, is enveloped by the annular steam sheath. The full stream comprising finely atomized and evenly distributed fuel oil droplets is then discharged into the furnace and combusted in the above-described manner.

A main advantage of the oil atomizing nozzle of the present invention is the fact that the steam conduits extend obliquely away from the steam chamber, typically at an angle to the nozzle axis of less than 45° and preferably at an angle of between 15°–30°. This relatively slight deviation of the conduits from the straight line greatly reduces energy losses in the steam and facilitates the smooth and rapid acceleration of the steam and fuel oil as it passes through the conduit. As a result the energy contained in the steam is efficiently utilized for atomizing the liquid fuel rather than for forcing the steam through intricate and multiple sharp turns, bends and the like. Thus, the nozzle can be operated as efficiently as prior art nozzles while consuming as little as one-third the steam of such prior art nozzles. This significant reduction in the steam consumption results in the earlier mentioned annual cost savings due to the reduced energy consumption for generating the atomizing steam.

I claim:

1. A method for introducing atomized liquid fuel into a furnace for combustion therein, the method comprising the steps of forming a core stream of a pressurized gas; forming a combined fuel and core stream by introducing at least two separate streams of the liquid fuel tangentially into the core stream, the fuel streams each lying within a plane radial to the core stream; forming an annular envelope stream of pressurized gas about the combined fuel and core stream; coaxially passing the combined fuel and core stream and the envelope stream through a common conduit; and thereafter substantially simultaneously discharging from the conduit into an enlarged space all streams; whereby the core stream and the envelope stream atomize the liquid fuel while contact between the liquid fuel and walls of the conduit is prevented.

2. A method according to claim 1 including the step of directing the core stream through a first portion of the conduit, and thereafter forming the fuel streams thereabout.

3. A method according to claim 2 wherein the fuel streams pass through apertures formed in walls of the conduit and oriented substantially tangentially to the core stream so that the core stream shears relatively small droplets of liquid fuel of the conduit wall at about the intersection of the apertures and the wall.

4. A method according to claim 3 wherein the step of flowing the liquid fuel through the apertures comprises the step of flowing the liquid fuel at a speed of about 50 ft. per second when fuel is atomized at a rate which constitutes the maximum rate at which fuel is combusted in the furnace.

5. A method according to claim 3 including the step of flowing the combined fuel and core stream through a second portion of the conduit having an increasing cross-sectional area in the direction of flow so that the pressure of the combined fuel and core stream is substantially equal to the pressure of the envelope stream at a point downstream of the apertures where the envelope stream is formed about the combined fuel and core stream.

6. A method according to claim 1 wherein the step of forming the annular envelope stream comprises the steps of initially flowing an annular stream of pressurized gas separate of the combined fuel and core stream, orienting the annular stream of pressurized gas substantially parallel to the combined fuel and core and stream, thereafter bringing the envelope stream into contact with the combined fuel and core stream and passing the combined fuel and core stream and the envelope stream in mutual contact through an outer portion of the conduit towards the enlarged space.

7. A method according to claim 6 wherein the outer portion of the conduit has an expanding cross-sectional area in the direction of flow so that the combined streams have a pressure substantially equal to the pressure in the enlarged space when they are discharged from the outermost conduit section.

8. A method according to claim 1 including the step of directing the combined fuel and core stream streams through a common conduit portion and thereafter forming the envelope stream thereabout.

9. A method according to claim 1 wherein the core stream has a generally cylindrical cross section.

10. A method according to claim 9 wherein the gas of the core stream and the gas of the envelope stream both comprise steam, and including the step of supplying no more than about 0.05 kg of steam for each kg of liquid fuel flowing in the fuel streams.

11. A method according to claim 10 wherein the step of supplying comprises the step of supplying at least about 0.03 kg of steam for each kg of liquid fuel flowing in the fuel streams.

12. A method according to claim 1 including the step of forming at least two sets of core, liquid fuel, and envelope streams, and supplying the sets of streams with pressurized gas and liquid fuel from a common liquid fuel source and a common pressurized gas source.

13. A method according to claim 12 including the step of flowing the liquid fuel from the source to the respective stream sets at a sufficient rate so that liquid fuel flows at substantially the same rate to each set irrespective of elevational differences between the sets.

14. A method according to claim 13 wherein the step of flowing the liquid fuel from the source to the respective sets comprises the step of flowing the liquid fuel from the source through a conduit into a disc-shaped cavity, oriented transversely to the passage and communicating with the conduits of the sets, at a rate of about 40 ft. per second when liquid fuel is combusted in the furnace at its maximum combustion rate so that the oil impinges on a surface of the cavity substantially perpendicular to the oil flow direction at a relatively high velocity sufficient to assure a substantially equal distribution of the oil to the sets.

15. A method for introducing atomized liquid fuel through a nozzle having a plurality of discharge ports into a furnace for combustion therein, the method comprising the steps of: providing first and second, separated chambers interiorly of the nozzle; flowing a core stream of a pressurized gaseous medium including steam from the first chamber along an axis inclined relative to a longitudinal axis of the nozzle to the ports; flowing liquid fuel from the second chamber towards each core stream and substantially equally dividing the flow of liquid fuel into a number of fuel branch flow equalling the number of core streams; directing each branch flow generally tangentially to the associated core stream into contact with the core stream so as to form a substantially homogenous, annular fuel stream surrounding the core stream; forming a secondary, annular stream of the medium for each core stream at a point downstream of the point at which the fuel stream is combined with the core stream; enveloping the combined core and fuel streams with the secondary stream; equalizing the pressure of the combined core and fuel streams and of the secondary stream at about the point where the latter envelops the former; and discharging each core stream and the associated, coaxial fuel and secondary streams from the corresponding ports into the furnace for combustion therein.

16. A method corresponding to claim 15 including the step of accelerating the combined streams prior to the step of discharging by reducing the pressure of the streams to about the pressure prevailing in the furnace.

17. A method according to claim 16 wherein the step of equally dividing comprises the step of flowing the liquid fuel from the second chamber into a disc-shaped cavity fluidly communicating with the core streams and oriented substantially perpendicular to the fuel flow from the second chamber and at a speed sufficient to substantially negate the effects of gravity on the flow of fuel in the branch flows; whereby substantially identical amounts of fuel are combined with all core streams and discharged from the ports.

18. A method according to claim 17 wherein the step of flowing the fuel from the second chamber towards the cavity comprises the step of flowing the fuel at a speed of up to about 40 ft. per second when liquid fuel is combusted in the furnace at its maximum rate.

19. A method according to claim 18 including the step of flowing fuel in the branch flows at a speed of up to about 20 ft. per second when liquid fuel is combusted in the furnace at its maximum rate.

20. A method according to claim 19 wherein the step of tangentially directing the liquid fuel comprises the step of flowing the liquid through tangentially oriented apertures surrounding the core stream at a speed of up to least about 50 ft. per second when the liquid fuel is combusted in the furnace at its maximum rate.

21. A nozzle for atomizing liquid fuel preparatory to its combustion in a furnace, the nozzle comprising: a generally axially oriented housing defining first and second, separated chambers; a discharge conduit in fluid communication with the first chamber and extending through the housing to the exterior thereof; the conduit having first, second and third axially aligned and spaced apart sections of successively large cross-sectional dimensions arranged successively from the first chamber through the housing to the exterior thereof and terminating in a discharge port at an end of the third section; first passage means defined by the housing communicating the first chamber with an upstream end of the third conduit section; second passage means fluidly communicating the second chamber with an upstream end of the second section and including at least two apertures disposed tangentially to the periphery of the first section; whereby the introduction of a pressurized gas in the first chamber and the introduction of a pressurized liquid fuel into the second chamber causes the formation of a gas-fuel mixture in the third conduit section comprised of a primary gaseous core stream, an annular fuel comprised of a primary gaseous core stream, an annular fuel stream surrounding the core stream, and a secondary gaseous stream enveloping the fuel stream; and whereby further the gaseous streams cause the atomization of the liquid fuel and protect housing walls defining the conduit and in the vicinity of the port from direct contact with the fuel and thereby also prevent a deposition of fuel particles on the walls.

22. A nozzle according to claim 21 wherein the first passage means comprises means for forming an annular flow of pressurized gas substantially parallel to the axis of the conduit before the pressurized gas reaches the upstream end of the third conduit section.

23. A nozzle according to claim 21 including means in the conduit for substantially equalizing the pressure of the combined core and annular fuel streams and of the secondary stream at about the upstream end of the third conduit section.

24. A nozzle according to claim 21 including means in the third conduit section for substantially equalizing the pressure of the combined core, fuel and secondary streams with the pressure prevailing on the exterior of the nozzle to thereby accelerate the combined stream before it reaches the port.

25. A nozzle according to claim 21 there are a plurality of conduits in the housing, and wherein the second passage means comprises a generally disc-shaped cavity oriented transversely to the nozzle axis and in fluid communication with the second chamber, and means communicating the cavity with the second chamber, the last mentioned means, and the cavity being formed so as to prevent gravitational forces from causing an unequal fluid flow to the conduits.

26. A nozzle according to claim 25 wherein axes of the conduits are inclined relative to an axis of the nozzle by not substantially more than about 30°.

27. A nozzle according to claim 21 wherein the second chamber is centrally disposed within the housing and the first chamber generally surrounds the second chamber.

28. A nozzle according to claim 21 wherein the first chamber is centrally disposed within the housing and is generally surrounded by the second chamber.

29. A nozzle for introducing atomized liquid fuel into a furnace for combustion therein, the nozzle comprising: an inner member defining a fuel compartment, a housing surrounding the inner member and defining in conjunction with the inner member a chamber; a conduit extending from the chamber to an exterior of the housing and forming axially aligned and successively spaced first, second and third conduit sections, the first section communicating with the chamber and the third section terminating in a discharge port at an outer surface of the housing, the first, second and third sections having consecutively larger diameters; a first passage fluidly communicating the compartment with a wall defining an upstream end of the second conduit section, the wall including a plurality of circumferentially spaced apart apertures oriented generally tangentially with respect to the second conduit section; whereby the application of pressurized liquid fuel to the compartment and of pressurized gas to the chamber forms a gas core stream flowing through the sections and an annular liquid fuel stream surrounding the core stream and flowing through the second and third conduit sections, the core and fuel streams forming a combined stream; and whereby further the introduction of liquid fuel through the apertures into the second conduit section causes an atomization of liquid fuel so that the annular fuel stream comprises atomized liquid fuel; second passage means communicating with the chamber; tubular wall means downstream of the wall, surrounding the combined stream, spaced from the housing and defining with the housing an annular space in communication with the second passage means, oriented parallel and coaxial to the conduit, and terminating at and communicating with an upstream end of the third conduit section; whereby pressurized gas from the chamber flows through the second passage means and the annular space to form an annular, secondary gas stream enveloping the combined stream; and whereby further the combined stream and the annular stream are simultaneously discharged from the port, the discharged liquid fuel being atomized, and direct contact between the liquid fuel and the housing is prevented to thereby enhance the combustion of the liquid fuel and prevent an accumulation of fuel particles on the nozzle.

30. Apparatus according to claim 29 wherein the wall and the tubular wall means are integrally constructed and form a continuous tubular member extending from about the upstream end of the second conduit section to about the upstream end of the third conduit section.

31. A nozzle according to claim 30 wherein the tubular member also forms the first conduit section and is defined by an insert connected with the housing.

32. A nozzle according to claim 31 including a restrictor defined by the insert and having a central, reduced diameter hole defining the first conduit section.

33. A nozzle according to claim 32 wherein a downstream end of the insert includes a conically shaped end portion of the second conduit section diverging in a downstream direction, the conically shaped portion being sized so that the combined stream has a pressure substantially equal to the pressure of the enveloping stream at about the upstream end of the third section.

34. A nozzle according to claim 31 wherein the insert is secured to the inner member.

35. A nozzle for introducing atomized liquid fuel into a furnace for combustion therein, the nozzle comprising an inner member defining a chamber for connection to a source of a pressurized, gaseous medium, a shell in surrounding relationship disposed about the member, the shell defining a compartment and including means for supplying liquid fuel to the compartment; a discharge conduit extending through the member and the shell and communicating the chamber with a port at an exterior of the shell so as to flow a core stream of the medium in the conduit; an insert disposed between the member and the shell, the insert having a first wall spaced apart from the shell and defining a first passage in communication with the compartment and the conduit at a first point intermediate the chamber and the port and arranged so as to flow the liquid fuel annularly about the core stream flowing from the chamber through the conduit; the insert having a second wall spaced apart from the member and defining a second passage communicating the chamber with the conduit at a second point disposed between the first point and the port and arranged so as to flow gaseous medium generally annularly about the liquid fuel flowing in the conduit between the first point and the port; the insert defining a first section of the conduit intermediate the member and the shell and having a diameter larger than the portion of the conduit through the member; the first passage having a lateral extent in a direction transverse to the axis of and larger than the diameter of the first conduit section; whereby an atomized liquid fuel stream of a generally annular cross-section issues from the conduit and the core stream and an annular exterior stream of gaseous medium prevents fuel from contacting portions of the shell defining the conduit and the port.

36. Apparatus according to claim 35 wherein a third section of the conduit is defined by the shell and has a diameter larger than the first conduit section.

37. Apparatus according to claim 36 wherein the second passage has a lateral extent in a direction transverse to the axis of the conduit which is larger than the diameter of the third conduit section.

38. Apparatus according to claim 37 including means establishing fluid communication between the chamber and the second passageway.

* * * * *